US011741912B2

(12) United States Patent
Liu et al.

(10) Patent No.: US 11,741,912 B2
(45) Date of Patent: Aug. 29, 2023

(54) LIQUID CRYSTAL DISPLAY BACKLIGHT MODULE CONTROLLING METHOD AND CONTROLLING DEVICE THEREOF

(71) Applicant: TCL China Star Optoelectronics Technology Co., Ltd., Guangdong (CN)

(72) Inventors: Jinfeng Liu, Guangdong (CN); Xuebing Zhou, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 283 days.

(21) Appl. No.: 17/255,009

(22) PCT Filed: Dec. 18, 2020

(86) PCT No.: PCT/CN2020/137607

§ 371 (c)(1),
(2) Date: Dec. 22, 2020

(87) PCT Pub. No.: WO2022/116293

PCT Pub. Date: Jun. 9, 2022

(65) Prior Publication Data

US 2022/0406265 A1 Dec. 22, 2022

(30) Foreign Application Priority Data

Dec. 2, 2020 (CN) ..... 202011402881.1

(51) Int. Cl.
*G09G 3/34* (2006.01)

(52) U.S. Cl.
CPC ..... *G09G 3/3426* (2013.01)

(58) Field of Classification Search
CPC ..... G09G 3/3426
See application file for complete search history.

(56) References Cited

U.S. PATENT DOCUMENTS

2019/0180700 A1* 6/2019 Gu ..... G09G 3/3426
2020/0410945 A1* 12/2020 Ji ..... G09G 3/3426

FOREIGN PATENT DOCUMENTS

| | | |
|---|---|---|
| CN | 105405412 | 3/2016 |
| CN | 110114818 | 8/2019 |
| CN | 111781771 | 10/2020 |
| WO | WO 2012/014588 | 2/2012 |

* cited by examiner

*Primary Examiner* — Towfiq Elahi

(57) ABSTRACT

A liquid crystal display backlight module controlling method and a controlling device thereof disclosed in the present invention includes a programmable logic gate array board extracting backlight information from an image signal. Calculation of local dimming is performed by the programmable logic gate array board, a calculation buffer for local dimming calculation is sufficient, which can increase liquid crystal display backlight divisions. Furthermore, the present invention employs a row signal and a column signal to control and switch on light emitting diodes in the backlight light board, which can achieve the cost lowering effect.

17 Claims, 9 Drawing Sheets

LIQUID CRYSTAL DISPLAY BACKLIGHT MODULE CONTROLLING METHOD AND CONTROLLING DEVICE THEREOF

RELATED APPLICATIONS

This application is a National Phase of PCT Patent Application No. PCT/CN2020/137607 having International filing date of Dec. 18, 2020, which claims the benefit of priority of Chinese Patent Application No. 202011402881.1 filed on Dec. 2, 2020. The contents of the above applications are all incorporated by reference as if fully set forth herein in their entirety.

FIELD AND BACKGROUND OF THE INVENTION

The present invention relates to a field of displays, especially relates to a liquid crystal display backlight module controlling method and a controlling device thereof.

At present, with development of economics, people has greater demands on television products, image quality is one of the most important parts. Usually, an organic Electroluminescence Display (OLED) can be made to control each pixel. Therefore, image quality of the OLED is superior to a liquid crystal display. However, according to related data, LCD products by manufacturing high division local dimming products can achieve high contrast as performed by an OLED. When the LCD divisions reaches 5000 or more, the display level is equal to that of the OLED, and brightness thereof can also exceed that of the OLED.

However, in the present television (TV) market, LCDs are products with divisions less than 1000. Local dimming functions of conventional TV solutions are calculating screen images information through a system on chip (SOC), then transmitting the information through two serial peripheral interfaces (SPIs) to a driver board to drive a backlight. However, such solution due to requirement of self-implementation of a software system has an insufficient calculation buffer for local dimming calculation, and therefore can only support a backlight solution of low division.

Therefore, achieving LCD TVs supporting high division is an urgent technical issue to display panel manufacturers.

SUMMARY OF THE INVENTION

Technical Issue

The embodiment of the present invention provides a liquid crystal display backlight module controlling method and a controlling device thereof that can solve the technical issue of a conventional LCD TV unable to support high division.

Technical Solution

The embodiment of the present invention provides a liquid crystal display backlight module controlling method, the controlling method comprising:

receiving an image signal of an image to be displayed;

by a programmable logic gate array board extracting backlight information from the image signal, wherein the backlight information is a position relationship of light emitting diodes and brightness degrees of the light emitting diodes in a backlight light board;

processing the backlight information to obtain a low voltage differential signal;

by a convertor circuit board processing the low voltage differential signal to obtain an electrical level signal;

by a driver circuit board processing the electrical level signal to obtain a row signal and a column signal; and by the row signal and the column signal switching on the light emitting diodes in the backlight light board.

In the liquid crystal display backlight module controlling method provided by the embodiment of the present invention, the step of by the programmable logic gate array board extracting the backlight information from the image signal comprises:

extracting grayscale information from the image signal; and mapping out the backlight information according to the grayscale information.

In the liquid crystal display backlight module controlling method provided by the embodiment of the present invention, before the step of by a convertor circuit board processing the low voltage differential signal to obtain an electrical level signal, the method further comprises:

by the convertor circuit board receiving a direct current voltage outputted by a power module; and converting the direct current voltage into direct current voltages of different values for supplying the liquid crystal display backlight module.

In the liquid crystal display backlight module controlling method provided by the embodiment of the present invention, the step of converting the direct current voltage into direct current voltages of different values for supplying the liquid crystal display backlight module comprises:

by a boost unit increasing a value of the direct current voltage for supplying the liquid crystal display backlight module.

In the liquid crystal display backlight module controlling method provided by the embodiment of the present invention, the step of converting the direct current voltage into direct current voltages of different values for supplying the liquid crystal display backlight module comprises:

by a buck unit decreasing a value of the direct current voltage for supplying the liquid crystal display backlight module.

In the liquid crystal display backlight module controlling method provided by the embodiment of the present invention, the step of by the row signal and the column signal switching on the light emitting diodes in the backlight light board comprises:

sequentially transmitting the row signal and the column signal to the backlight light board, wherein the row signal controls each row of the light emitting diodes of the backlight light board, and the column signal controls each column of the light emitting diodes of the backlight light board; and when both the row signal and the column signal are in a predetermined status with an identification value of switching on, switching on corresponding ones of the light emitting diodes.

In the liquid crystal display backlight module controlling method provided by the embodiment of the present invention, after the step of by the programmable logic gate array board extracting the backlight information from the image signal, the method further comprises:

by the programmable logic gate array board extracting clock information from the image signal, wherein the clock information is a timing signal controlling display of a liquid crystal display panel.

In the liquid crystal display backlight module controlling method provided by the embodiment of the present invention, after the step of by a programmable logic gate array board extracting backlight information from the image signal, the method further comprises:

processing the clock information to obtain a point-to-point signal.

In the liquid crystal display backlight module controlling method provided by the embodiment of the present invention, after the step of processing the clock information to obtain a point-to-point signal, the method further comprises:

outputting the point-to-point signal into the liquid crystal display panel for the liquid crystal display panel to display screen images.

The present invention also provides a liquid crystal display backlight module controlling device, the liquid crystal display backlight module controlling device comprises a programmable logic gate array board, a convertor circuit board, and a driver circuit board that are sequentially connected; wherein the programmable logic gate array board is configured to receive an image signal of an image to be displayed, is configured to extract backlight information from the image signal with the backlight information being position relationships and brightness degrees of light emitting diodes in a backlight light board, is configured to process the backlight information to obtain a low voltage differential signal, and is configured to transmit the low voltage differential signal to the convertor circuit board;

the convertor circuit board is configured to receive the low voltage differential signal and process the low voltage differential signal to obtain an electrical level signal, and is configured to transmit the electrical level signal to the driver circuit board; and the driver circuit board is configured to receive the electrical level signal and process the electrical level signal to obtain a row signal and a column signal, is configured to transmit the row signal and the column signal to the backlight light board to switch on the light emitting diodes in the backlight light board.

In the liquid crystal display backlight module controlling device provided by the embodiment of the present invention, the programmable logic gate array board comprises an extraction unit, a mapping unit, a first process unit, and a first transmission unit; the extraction unit is configured to extract grayscale information from the image signal, the mapping unit is configured to map out the backlight information according to the grayscale information, the first process unit is configured to convert the backlight information into a low voltage differential signal, the first transmission unit is configured to transmit the low voltage differential signal to the convertor circuit board.

In the liquid crystal display backlight module controlling device provided by the embodiment of the present invention, the programmable logic gate array board further comprises a second extraction unit; the second extraction unit is configured to extract clock information from the image signal, wherein the clock information is a timing signal for controlling display of the a liquid crystal display panel.

In the liquid crystal display backlight module controlling device provided by the embodiment of the present invention, the convertor circuit board comprises a second process unit and a second transmission unit; the second process unit is configured to convert the low voltage differential signal into an electrical level signal, and the second transmission unit is configured to transmit the electrical level signal to the driver circuit board.

In the liquid crystal display backlight module controlling device provided by the embodiment of the present invention, the convertor circuit board further comprises a voltage process unit; the voltage process unit is configured to receive a direct current voltage outputted by a power module, and to convert the direct current voltage into direct current voltages of different values for supplying the liquid crystal display backlight module.

In the liquid crystal display backlight module controlling device provided by the embodiment of the present invention, the voltage process unit comprises a boost unit, the boost unit is configured to increase a value of the direct current voltage for supply the liquid crystal display backlight module.

In the liquid crystal display backlight module controlling device provided by the embodiment of the present invention, the voltage process unit comprises a buck unit, the buck unit is configured to decrease a value of the direct current voltage for supplying the liquid crystal display backlight module.

In the liquid crystal display backlight module controlling device provided by the embodiment of the present invention, a number of the convertor circuit board is two.

In the liquid crystal display backlight module controlling device provided by the embodiment of the present invention, the driver circuit board comprises a third process unit, a third transmission unit and a lighting-up unit; wherein the third process unit is configured to convert the electrical level signal into a row signal and a column signal, the transmission unit is configured to sequentially transmit the row signal and the column signal to the backlight light board, the row signal controls each row of the light emitting diodes of the backlight light board, the column signal controls each column of the light emitting diodes of the backlight light board, the lighting-up unit is configured to switch on corresponding ones of the light emitting diodes when both the row signal and the column signal are in a predetermined status with an identification value of switching on.

In the liquid crystal display backlight module controlling device provided by the embodiment of the present invention, the liquid crystal display backlight module further comprises a logic control board, the logic control board is configured to receive the clock information and processes the clock information to obtain a point-to-point signal and transmit the point-to-point signal to the liquid crystal display panel, and is configured to drive the liquid crystal display panel to display screen images.

In the liquid crystal display backlight module controlling device provided by the embodiment of the present invention, the logic control board comprises a fourth process unit and a fourth output unit; wherein the fourth process unit is configured to process the clock information to obtain the point-to-point signal, the fourth output unit is configured to transmit the point-to-point signal to the liquid crystal display panel, and is configured to drive the liquid crystal display panel to display screen images.

Advantages

In the liquid crystal display backlight module controlling method and the controlling device thereof provided by the embodiment of the present invention, by inputting image signals of images to be displayed into a liquid crystal display backlight module, calculates local dimming through a programmable logic gate array board in the liquid crystal display backlight module, and the programmable logic gate array board has no need to implement a software system. Therefore, calculation buffer for calculating local dimming is sufficient and can support local dimming calculation of high division, which can improve a number of liquid crystal display backlight divisions and achieve effect of enhancement to image quality. Furthermore, the present invention employs row signals and column signals to control and switch on light emitting diodes in the backlight light board, which can effectively reduce channels of output signals such that under a condition of super high division, a number of integrated circuit chips (ICs) is effectively reduced to achieve effect of lowering the cost.

BRIEF DESCRIPTION OF THE SEVERAL VIEWS OF THE DRAWINGS

Specific embodiments of the present invention are described in details with accompanying drawings as follows to make technical solutions and advantages of the present invention clear.

DESCRIPTION OF SPECIFIC EMBODIMENTS OF THE INVENTION

The technical solution in the embodiment of the present invention will be clearly and completely described below with reference to the accompanying drawings in the embodiments of the present invention. Apparently, the described embodiments are merely some embodiments of the present invention instead of all embodiments. According to the embodiments in the present invention, all other embodiments obtained by those skilled in the art without making any creative effort shall fall within the protection scope of the present invention.

Figure 1:
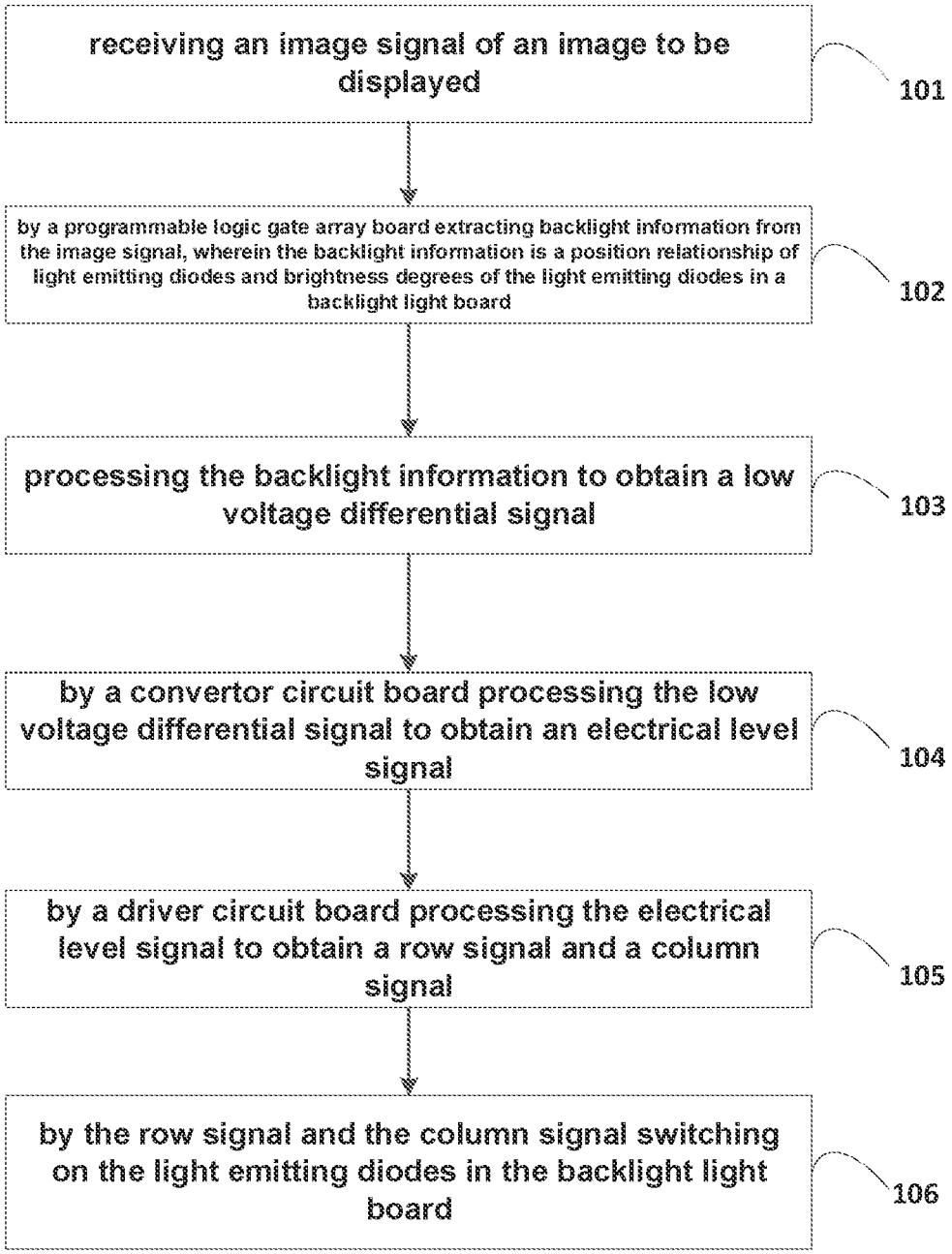
FIG. 1 is a schematic flowchart of a first controlling method of a liquid crystal display backlight module provided by an embodiment of the present invention.

Specifically, with reference to FIG. 1, FIG. 1 is a schematic flowchart of a first controlling method of a liquid crystal display backlight module provided by an embodiment of the present invention. A first controlling method of the liquid crystal display backlight module provided by the embodiment of the present invention comprises steps 101 to 106 as follows.

The step 101 comprises receiving an image signal of an image to be displayed.

In image communication, usually visible information such as visible screen images is converted into an electrical signal for transmission, and such electrical signal is the image signal.

A method of the system chip outputting the image signal of the image to be displayed to the liquid crystal display backlight module is a Video-By-One (VBO) technology. The VBO technology is a digital interface standard technology aiming at image information transmission, compared to the low voltage differential signal (Low-Voltage Differential Signaling, LVDS), using the VBO technology can achieve image signal transmission in higher speed, and its encoding method avoids a time lag issue between receiving end data and clock. Therefore, the VBO technology is extensively applied to a field of super high definition liquid crystal televisions.

The image signal of the image to be displayed not only comprises clock information of the image to be displayed but also comprises backlight information of the image to be displayed.

The clock information refers to a timing signal controlling display of the liquid crystal display panel, and is configured to control switch-on of a circuit controlling arrangement of liquid crystal molecules and a timing of the switch-on such that the liquid crystal display panel displays screen images in appropriate time through appropriate light.

The step 102 comprises by a programmable logic gate array board extracting backlight information from the image signal, wherein the backlight information is a position relationship of light emitting diodes and brightness degrees of the light emitting diodes in a backlight light board.

The backlight information is a position relationship of light emitting diodes and brightness degrees of the light emitting diodes in a backlight light board, specifically, the information of the divisions of the backlight light board can be known according to the backlight information, for example, numbers of rows and columns of the backlight light board, a number of the divisions. Further, a brightness degree of each light emitting diode in each division of the backlight light board, for example brightness degrees of the light emitting diodes of a division of a first row and a first column, brightness degrees of the light emitting diodes of a division of a first row and a second column division, and brightness degrees of the light emitting diodes of a division of a second row and a first column division, can be known according to the backlight information.

Calculation of local dimming is implemented by the programmable logic gate array board in the liquid crystal display backlight module. First, the programmable logic gate array board requires no implementation of a software system. Therefore, calculation buffer for calculation of local dimming is sufficient. Second, the programmable logic gate array board is a programmable logic array board and can build algorithm structure according actual demands to implement calculation and control of super high division such that the number of the divisions of the liquid crystal display backlight can be increased to achieve the effect of image quality enhancement.

The liquid crystal display backlight module also extracts clock information from the image signal and transmits clock information in form of VBO signal to a logic control chip. The logic control chip converts the VBO signal into a point-to-point (P2P) signal, and transmit the P2P signal to the liquid crystal display panel to allow the liquid crystal display panel to display screen images.

Figure 2:
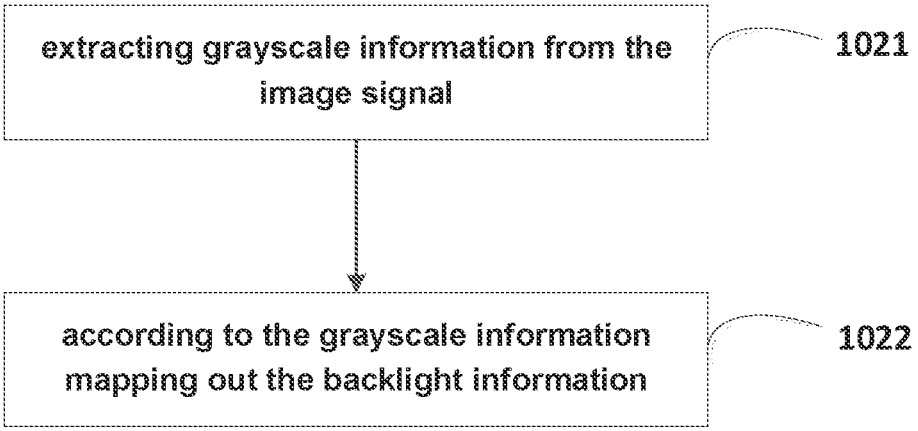
FIG. 2 is a first sub-schematic flowchart of the liquid crystal display backlight module controlling method provided by the embodiment of the present invention.

Specifically, with reference to FIG. 2, FIG. 2 is a first sub-schematic flowchart of the liquid crystal display backlight module controlling method provided by the embodiment of the present invention. In the liquid crystal display backlight module controlling method provided by the embodiment of the present invention, the step 102 specifically comprises steps 1021 and 1022.

The step 1021 comprises extracting grayscale information from the image signal.

The image to be displayed is defined as two-dimensional function f (x, y), wherein a value of f is called grayscale information of an image to be displayed on a point (x, y). Extracting grayscale information from the image signal means obtaining coordinates of all points of the image to be displayed and corresponding values of f thereof.

The step 1022 comprises according to the grayscale information mapping out the backlight information.

According to the grayscale information mapping out the backlight information means matching coordinates (x, y) of all points in the image to be displayed with the light emitting diodes respectively to obtain a position relationship of the light emitting diodes, and then according to values of f corresponding to coordinates (x, y) of all points in a displayed screen image obtaining brightness degree of each of the light emitting diodes.

The step 103 comprises processing the backlight information to obtain a low voltage differential signal.

The image information comprises backlight information and clock information. The VBO signal can prevent can avoid a time lag issue between receiving end data and the clock because of its specific encoding method. Therefore, the VBO signal is usually used to transmit image information. However, using the VBO signal to transmit the image information has certain instability. However, a low voltage differential signal is data-transmitted through a pair of differential signal lines, which has higher transmission efficiency and is stable. Therefore, when image information only comprising backlight information is transmitted, the low voltage differential signal can be used.

The step 104 comprises by a convertor circuit board processing the low voltage differential signal to obtain an electrical level signal.

The low voltage differential signal is decoded by a decoding module in the convertor circuit board to convert the low voltage differential signal into a standard electrical level signal.

The step 105 comprises by a driver circuit board processing the electrical level signal to obtain a row signal and a column signal.

A video process module is used to process the electrical level signal to obtain a horizontal coordinate, a vertical coordinate, and a brightness degree of each of the light emitting diodes in the backlight light board. According to the horizontal coordinate, the vertical coordinate, and the brightness degree of each of the light emitting diodes in the backlight light board, a specific algorithm is used to obtain a row signal controlling each row of the light emitting diodes in the backlight light board and a column signal controlling each column of the light emitting diodes in the backlight light board.

The step 106 comprises by the row signal and the column signal switching on the light emitting diodes in the backlight light board.

A method of sequentially outputting the row signal and the column signal to the backlight light board to drive and switch on the light emitting diodes of the backlight light board.

Figure 3:
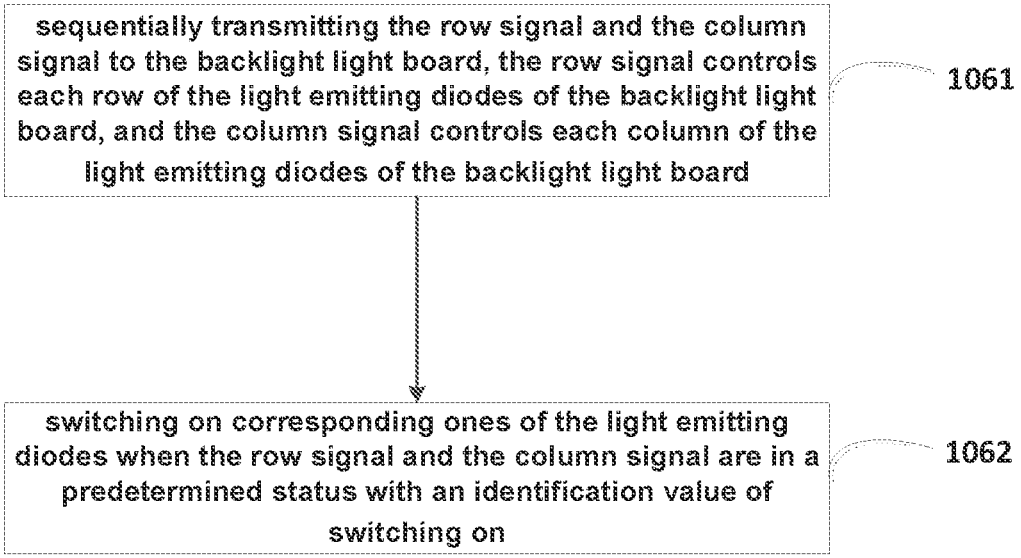
FIG. 3 is a second sub-schematic flowchart of the liquid crystal display backlight module controlling method provided by the embodiment of the present invention.

Specifically, with reference to FIG. 3, FIG. 3 is a second sub-schematic flowchart of the liquid crystal display backlight module controlling method provided by the embodiment of the present invention. The step 106 of the liquid crystal display backlight module controlling method provided by the embodiment of the present invention specifically comprises steps 1061 and 1062.

The step 1061 comprises sequentially transmitting the row signal and the column signal to the backlight light board, the row signal controls each row of the light emitting diodes of the backlight light board, and the column signal controls each column of the light emitting diodes of the backlight light board.

The row signal and the column signal have a transmission sequence such that the light emitting diodes would not be switched on wrongly.

The step 1062 comprises switching on corresponding ones of the light emitting diodes when the row signal and the column signal are in a predetermined status with an identification value of switching on.

The row signal in a predetermined status with an identification value of switching on means that row signal is switched on, and so does the column signal. The row signal and the column signal in a predetermined status with an identification value of switching on means that both the row signal and the column signal is switched on.

When the light emitting diodes of the backlight light board are switched on, the row signal and the column signal are in a NAND gate relation, as long as one of the row signal and the column signal is switched off, the light emitting diodes of the backlight light board would not be switched on. Only both the row signal and the column signal are switched on can the light emitting diodes in the backlight light board be switched on.

In an embodiment, the backlight light board comprises twelve backlight sub-light boards, a specific division method of each of the backlight sub-light boards is 27 rows and 16 columns, totally 432 divisions, and the backlight light board are totally divided into 5184 divisions.

When the light emitting diodes of a division of a first row and a fifth column of a first backlight sub-light board is to be switched on, a row signal of the first row of the first backlight sub-light board is outputted to the backlight light board to switch it on. A column signal of the fifth column of the first backlight sub-light board is controlled and outputted to the backlight light board switch it on. As such, light emitting diodes in a division of first row and fifth column of the first backlight sub-light board can be lighted up. By the method above, all of the light emitting diodes of all divisions of the backlight light board.

When the backlight light board division is as described above, controlling each of the backlight sub-light boards only requires 43 (27+16) channels. Only three chips of 16 channels are required to control and switch on light emitting diodes in one backlight sub-light board, and only 36 chips of 16 channels are required to control the entire backlight light board. If a conventional pulse width modulation (PWM) signal is used to control and switch on such backlight light board, 5184 channels will be required. When a chip of 16 channels is employed, 324 chips of 16 channels are required. The present invention switches on the light emitting diodes of the backlight light board by sequentially transmitting the row signal and the column signal to the backlight light board, which can effectively reduce a number of chips to achieve the cost lowering effect.

Figure 4:
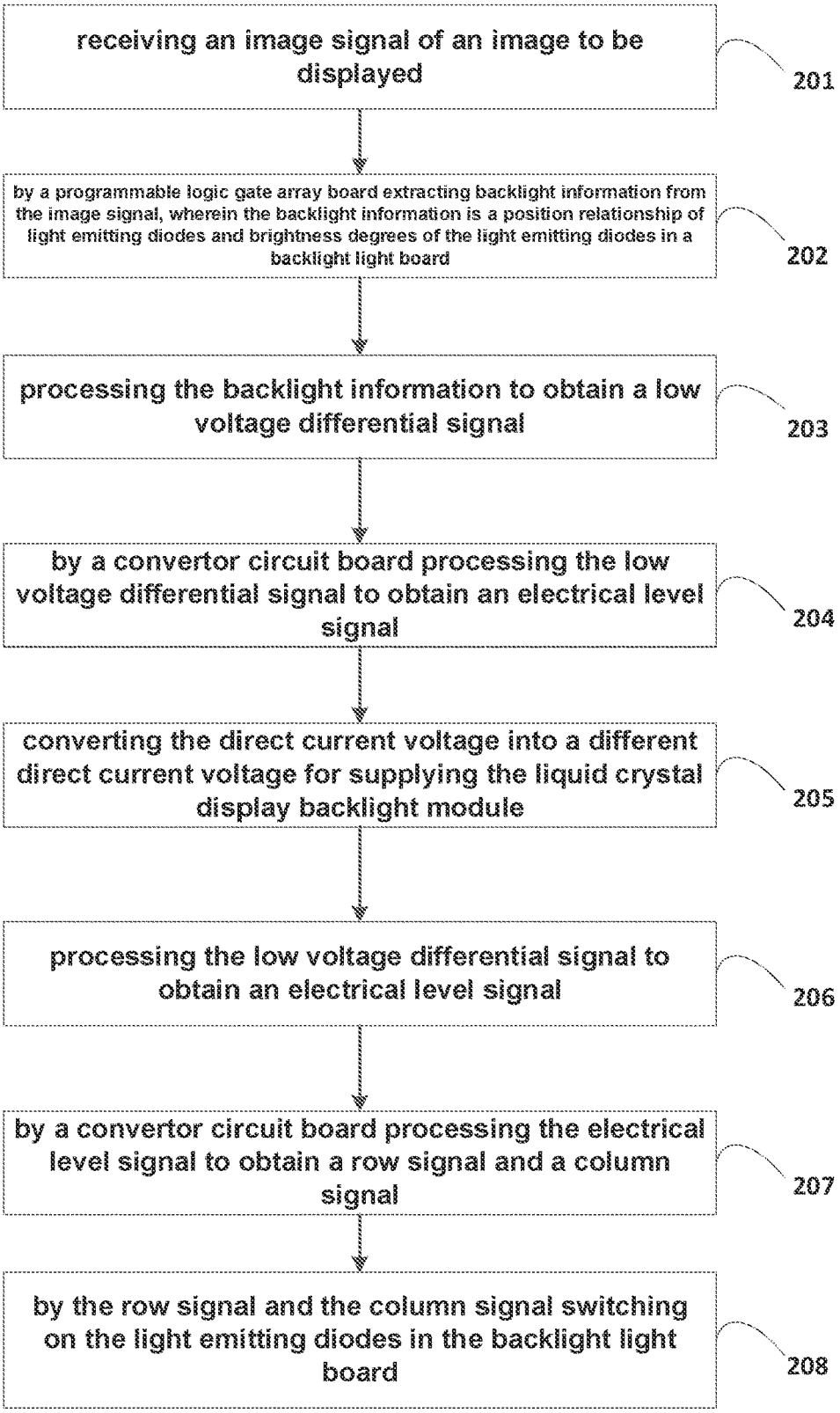
FIG. 4 is a schematic flowchart of a second controlling method of the liquid crystal display backlight module provided by the embodiment of the present invention.

Specifically, with reference to FIG. 4, FIG. 4 is a schematic flowchart of a second controlling method of the liquid crystal display backlight module provided by the embodiment of the present invention. A second controlling method of the liquid crystal display backlight module provided by the embodiment of the present invention specifically comprises steps 201 to 208 as follows.

The step 201 comprises receiving an image signal of an image to be displayed.

The step 202 comprises by a programmable logic gate array board extracting backlight information from the image signal, wherein the backlight information is a position relationship of light emitting diodes and brightness degrees of the light emitting diodes in a backlight light board.

The step 203 comprises processing the backlight information to obtain a low voltage differential signal.

The step 204 comprises by a convertor circuit board processing the low voltage differential signal to obtain an electrical level signal.

A voltage transmitted by the power module to the liquid crystal display backlight module is a direct current voltage, and all values are the same.

The step 205 comprises converting the direct current voltage into a different direct current voltage for supplying the liquid crystal display backlight module.

Because various modules exist in the liquid crystal display backlight module and required voltage values thereof are different, a direct current voltage inputted from the power module needs conversion.

The value of the direct current voltage inputted by the power module is mainly changed by a boost unit and a buck unit disposed in the convertor circuit board for supplying other modules of the liquid crystal display backlight module, primarily for supplying the convertor circuit board and the driver circuit board.

The step 206 comprises processing the low voltage differential signal to obtain an electrical level signal.

The step 207 comprises by a convertor circuit board processing the electrical level signal to obtain a row signal and a column signal.

The step 208 comprises by the row signal and the column signal switching on the light emitting diodes in the backlight light board.

In the liquid crystal display backlight module controlling method provided by the present invention, by inputting image signals of images to be displayed into the liquid crystal display backlight module, calculates local dimming through the liquid crystal display backlight module, and the liquid crystal display backlight module requires no implementation of a software system. Therefore, calculation buffer configured for calculating local dimming is sufficient and can support local dimming calculation of high division, which can improve a number of liquid crystal display backlight divisions and achieve effect of enhancement to image quality. Furthermore, the present invention employs row signals and column signals to control and switch on light emitting diodes in the backlight light board, which can effectively reduce channels of output signals such that under a condition of super high division, a number of integrated circuit chips is effectively reduced to achieve effect of lowering the cost.

Figure 5:
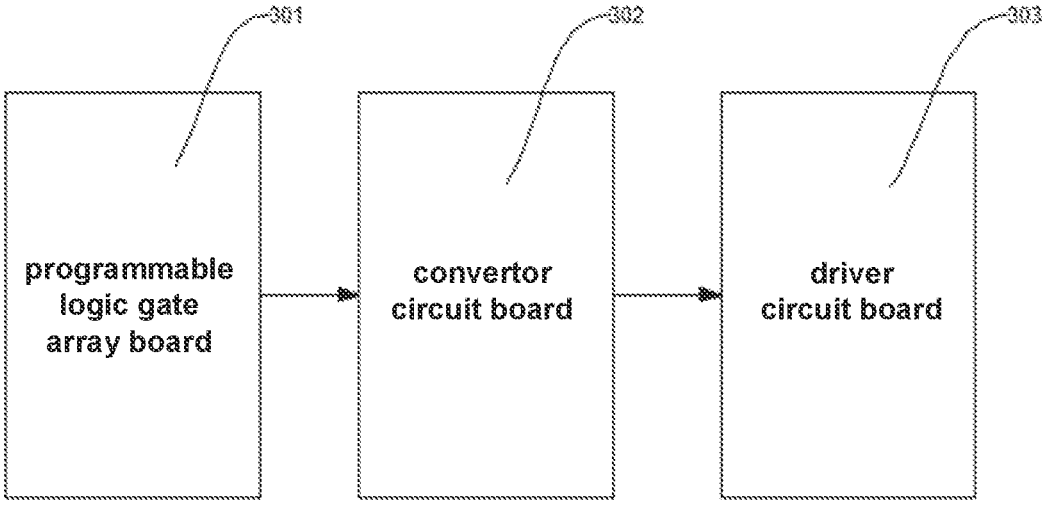
FIG. 5 is a schematic structural view of a liquid crystal display backlight module controlling device provided by the embodiment of the present invention.

Specifically, with reference to FIG. 5, FIG. 5 is a schematic structural view of a liquid crystal display backlight module controlling device 30 provided by the embodiment of the present invention. As shown in FIG. 5, the liquid crystal display backlight module controlling device 30 provided by the embodiment of the present invention comprises a programmable logic gate array board 301, a convertor circuit board 302, and a driver circuit board 303 that are sequentially connected to one another.

The programmable logic gate array board 301 is configured to receive the image signal of the image to be displayed, and is configured to extract backlight information from the image signal. The backlight information is a position relationship of light emitting diodes and brightness degrees of the light emitting diodes in a backlight light board. The programmable logic gate array board 301 processes the backlight information to obtain a low voltage differential signal. The programmable logic gate array board 301 transmits the low voltage differential signal to the convertor circuit board 302.

The convertor circuit board 302 is configured to receive the low voltage differential signal and process the low voltage differential signal to obtain an electrical level signal, and is configured to transmit the electrical level signal to the driver circuit board 303.

The driver circuit board 303 is configured to receive the electrical level signal and is configured to process the electrical level signal to obtain a row signal and a column signal, and transmit the row signal and the column signal to the backlight light board to switch on the light emitting diodes in the backlight light board.

The liquid crystal controller backlight module controlling device 30 further comprises a logic control board. The logic control board is configured to receive clock information, process the clock information to obtain a point-to-point signal, output the point-to-point signal to the liquid crystal display panel to allow the liquid crystal display panel to display screen images.

Figure 6:
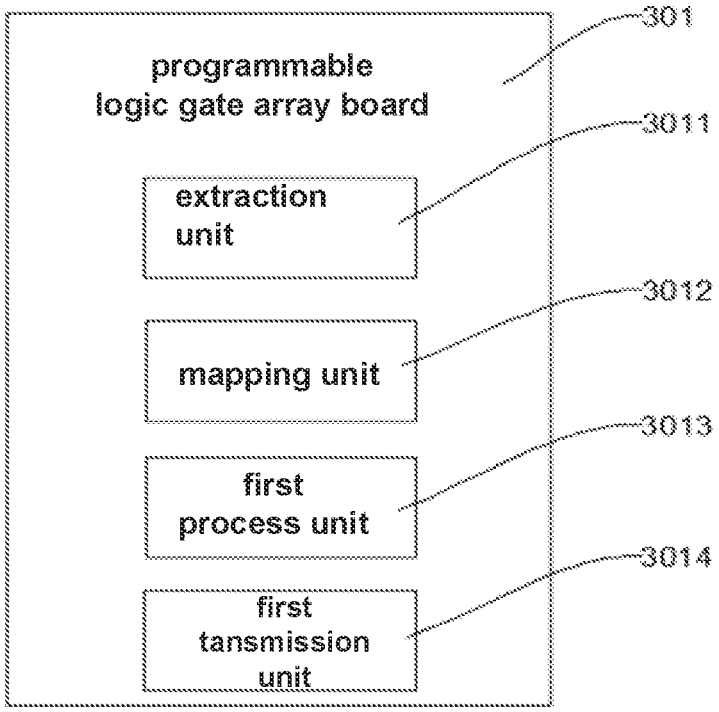
FIG. 6 is a schematic structural view of a programmable logic gate array board provided by the embodiment of the present invention.

The logic control board comprises a fourth process unit and a fourth output unit. The fourth process unit is configured to process the clock information to obtain a point-to-point signal. The fourth output unit is configured to output the point-to-point signal to the liquid crystal display panel to allow the liquid crystal display panel to display screen images. Specifically, with reference to FIG. 6, FIG. 6 is a schematic structural view of a programmable logic gate array board 301 provided by the embodiment of the present invention. The extraction unit programmable logic gate array board 301 provided by the embodiment of the present invention comprises an extraction unit 3011, a mapping unit 3012, a first process unit 3013, and a first transmission unit 3014 that are sequentially connected to one another.

The extraction unit 3011 is configured to extract grayscale information from the image signal. The mapping unit 3012 is configured to according to the grayscale information mapping out the backlight information. The first process unit 3013 is configured to convert the backlight information into a low voltage differential signal. The first transmission unit 3014 is configured to transmit the low voltage differential signal to the convertor circuit board 302.

The field programmable gate array (FPGA) board not only comprises an input/output module but also comprises a configurable logic module, and therefore can calculate local dimming. Furthermore, the FPGA board requires no implementation of a software system so can support local dimming calculation of super high division, which can increase a number of divisions of the liquid crystal display backlight division to achieve an effect of image quality enhancement.

The programmable logic gate array board further comprises a second extraction unit; wherein second extraction unit is configured to extract clock information from the image signal, and the clock information is a timing signal controlling display of the liquid crystal display panel.

Figure 7:
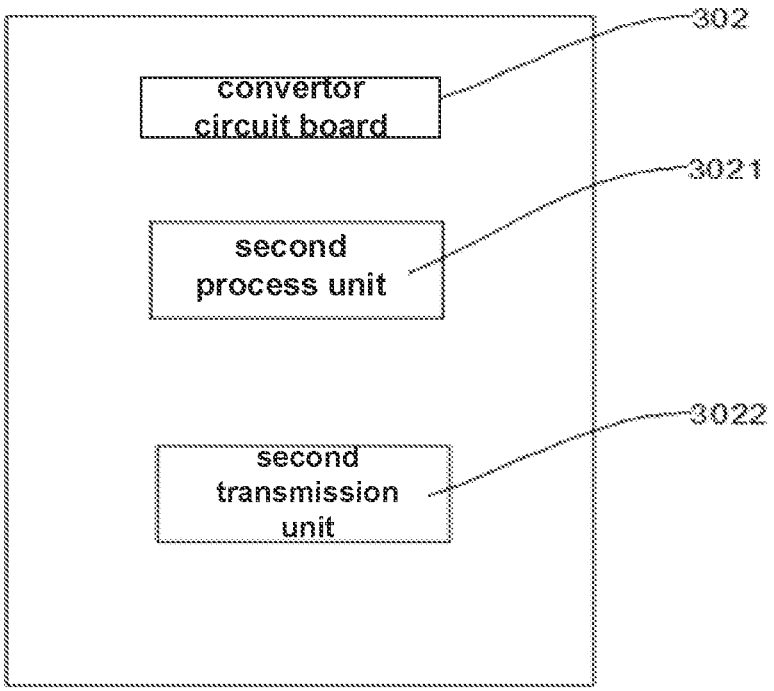
FIG. 7 is a first schematic structural view of a convertor circuit board provided by the embodiment of the present invention.

Specifically, with reference to FIG. 7, FIG. 7 is a first schematic structural view of a convertor circuit board 302 provided by the embodiment of the present invention. The convertor circuit board provided by the embodiment of the present invention 302 comprises a second process unit 3021 and a second transmission unit 3022 that are sequentially connected.

The second process unit 3021 is configured to convert a low voltage differential signal into an electrical level signal, and the second transmission unit 3022 is configured to transmit the electrical level signal to the driver circuit board 303.

In an embodiment, convertor circuit board is usually two. When the divisions of the backlight light board are excessive, the convertor circuit boards will be overloaded to affect conversion efficiency. Therefore, the convertor circuit board is two, and all divisions of the backlight light board are classified into a left half-region and a right half-region. Each of the left half-region of the backlight light board and the right half-region of the backlight light board occupies half the divisions of the backlight light board. Each of the convertor circuit boards controls half the divisions to prevent conversion efficiency due to overload of the convertor circuit boards.

Figure 8:
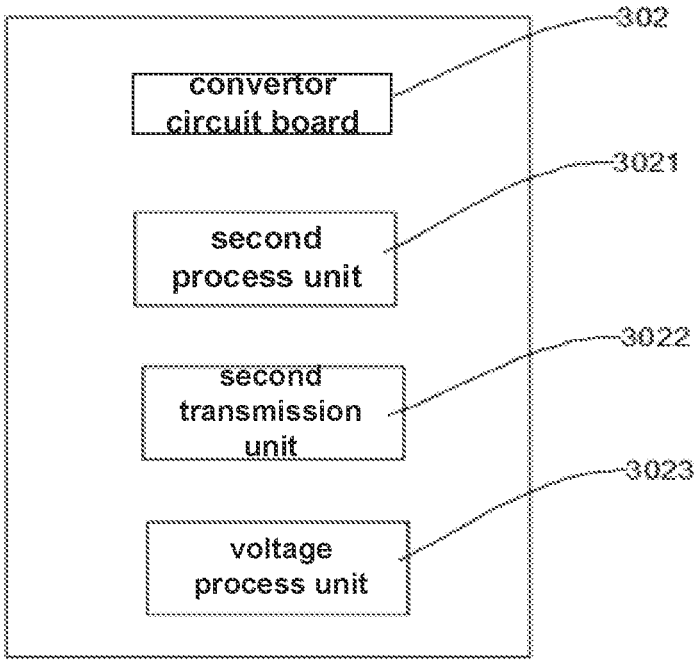
FIG. 8 is a second schematic structural view of the convertor circuit board provided by the embodiment of the present invention.

Specifically, with reference to FIG. 8, FIG. 8 is a second schematic structural view of the convertor circuit board 302 provided by the embodiment of the present invention. Compared to FIG. 7, the convertor circuit board 302 in FIG. 8 further comprises a voltage process unit 3023.

The voltage process unit 3023 is configured to receive a direct current voltage outputted by the power module, and convert the direct current voltage into direct current voltages of different values for supplying the liquid crystal display backlight module to use the direct current voltage, especially for supplying the convertor circuit board 302 and the driver circuit board 303.

The voltage process unit 3023 on only comprises a boost unit, but also comprises a buck unit, which can increase the direct current voltage of the power module and lower the direct current voltage inputted by the power module. Therefore, required voltages can be supplied to the convertor circuit board 302 and the driver circuit board 303.

Figure 9:
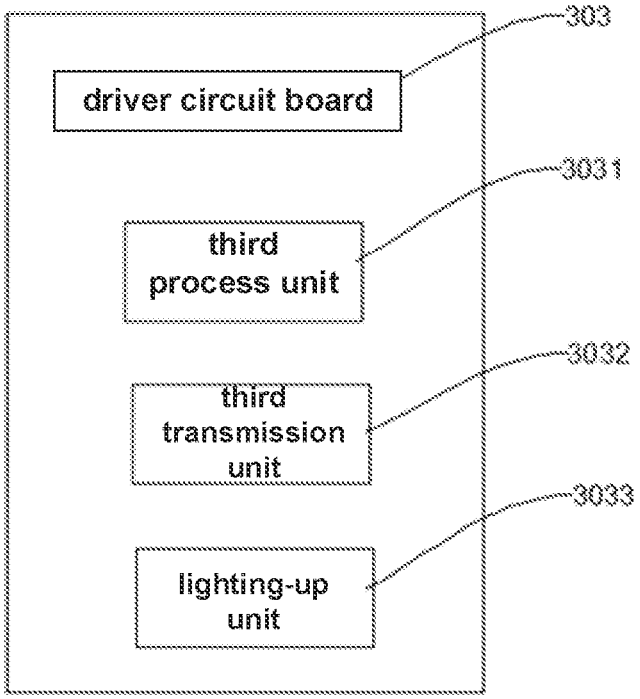
FIG. 9 is a schematic structural view of a driver circuit board provided by the embodiment of the present invention.

Specifically, with reference to FIG. 9, FIG. 9 is a schematic structural view of a driver circuit board provided by the embodiment of the present invention. The driver circuit board 303 provided by the embodiment of the present invention comprises a third process unit 3031, a third transmission unit 3032, and a lighting-up unit 3033.

The third process unit 3031 is configured to convert an electrical level signal into a row signal and a column signal. The third transmission unit 3032 is configured to sequentially transmit the row signal and the column signal to the backlight light board. The row signal controls each row of the light emitting diodes of the backlight light board. The column signal controls each column of the light emitting diodes of the backlight light board. The lighting-up unit 3033 is configured to when the row signal and the column signal are in a predetermined status with an identification value of switching on, switching on corresponding ones of the light emitting diodes.

The liquid crystal display backlight module controlling device provided by the present invention, by inputting the image signal of the image to be displayed into the programmable logic gate array board, calculates local dimming through the programmable logic gate array board, and the programmable logic gate array board requires no implementation of a software system. Therefore, calculation buffer configured for calculating local dimming is sufficient and can support local dimming calculation of high division, which can improve a number of liquid crystal display backlight divisions and achieve effect of enhancement to image quality. Furthermore, the present invention employs row signals and column signals to control and switch on light emitting diodes in the backlight light board, which can effectively reduce channels of output signals such that under a condition of super high division, a number of integrated circuit chips is effectively reduced to achieve effect of lowering the cost.

In the above-mentioned embodiments, the descriptions of the various embodiments are focused. For the details of the embodiments not described, reference may be made to the related descriptions of the other embodiments.

The liquid crystal display backlight module controlling method and the controlling device thereof provided by the embodiment of the present invention are described in detail as above. The principles and implementations of the present application are described in the following by using specific examples. The description of the above embodiments is only for assisting understanding of the technical solutions of the present application and the core ideas thereof. Those of ordinary skill in the art should understand that they can still modify the technical solutions described in the foregoing embodiments are or equivalently replace some of the technical features. These modifications or replacements do not depart from the essence of the technical solutions of the embodiments of the present application.

What is claimed is:

1. A liquid crystal display backlight module controlling method, comprising steps as follows:

receiving an image signal of an image to be displayed;

by a programmable logic gate array board extracting backlight information from the image signal, wherein the backlight information is a position relationship of light emitting diodes and brightness degrees of the light emitting diodes in a backlight light board;

processing the backlight information to obtain a low voltage differential signal;

by a convertor circuit board processing the low voltage differential signal to obtain an electrical level signal;

by a driver circuit board processing the electrical level signal to obtain a row signal and a column signal; and by the row signal and the column signal switching on the light emitting diodes in the backlight light board;

wherein before the step of by a convertor circuit board processing the low voltage differential signal to obtain an electrical level signal, the method further comprises:

by the convertor circuit board receiving a direct current voltage outputted by a power module; and converting the direct current voltage into direct current voltages of different values for supplying the liquid crystal display backlight module.

2. The liquid crystal display backlight module controlling method as claimed in claim 1, wherein the step of by the programmable logic gate array board extracting the backlight information from the image signal comprises:

extracting grayscale information from the image signal; and mapping out the backlight information according to the grayscale information.

3. The liquid crystal display backlight module controlling method as claimed in claim 1, wherein the step of converting the direct current voltage into direct current voltages of different values for supplying the liquid crystal display backlight module comprises:

by a boost unit increasing a value of the direct current voltage for supplying the liquid crystal display backlight module.

4. The liquid crystal display backlight module controlling method as claimed in claim 1, wherein the step of converting the direct current voltage into direct current voltages of different values for supplying the liquid crystal display backlight module comprises:

by a buck unit decreasing a value of the direct current voltage for supplying the liquid crystal display backlight module.

5. The liquid crystal display backlight module controlling method as claimed in claim 1, wherein the step of by the row signal and the column signal switching on the light emitting diodes in the backlight light board comprises:

sequentially transmitting the row signal and the column signal to the backlight light board, wherein the row signal controls each row of the light emitting diodes of the backlight light board, and the column signal controls each column of the light emitting diodes of the backlight light board; and when both the row signal and the column signal are in a predetermined status with an identification value of switching on, switching on corresponding ones of the light emitting diodes.

6. The liquid crystal display backlight module controlling method as claimed in claim 1, wherein after the step of by the programmable logic gate array board extracting the backlight information from the image signal, the method further comprises:

by the programmable logic gate array board extracting clock information from the image signal, wherein the clock information is a timing signal controlling display of a liquid crystal display panel.

7. The liquid crystal display backlight module controlling method as claimed in claim 6, wherein after the step of by a programmable logic gate array board extracting backlight information from the image signal, the method further comprises:

processing the clock information to obtain a point-to-point signal.

8. The liquid crystal display backlight module controlling method as claimed in claim 7, wherein after the step of processing the clock information to obtain a point-to-point signal, the method further comprises:

outputting the point-to-point signal into the liquid crystal display panel for the liquid crystal display panel to display screen images.

9. A liquid crystal display backlight module controlling device, wherein the liquid crystal display backlight module controlling device comprises a programmable logic gate array board, a convertor circuit board, and a driver circuit board that are sequentially connected; wherein the programmable logic gate array board is configured to receive an image signal of an image to be displayed, is configured to extract backlight information from the image signal with the backlight information being position relationships and brightness degrees of light emitting diodes in a backlight light board, is configured to process the backlight information to obtain a low voltage differential signal, and is configured to transmit the low voltage differential signal to the convertor circuit board;

the convertor circuit board is configured to receive the low voltage differential signal and process the low voltage differential signal to obtain an electrical level signal, and is configured to transmit the electrical level signal to the driver circuit board; and the driver circuit board is configured to receive the electrical level signal and process the electrical level signal to obtain a row signal and a column signal, is configured to transmit the row signal and the column signal to the backlight light board to switch on the light emitting diodes in the backlight light board;

wherein the convertor circuit board comprises a second process unit and a second transmission unit; the second process unit is configured to convert the low voltage differential signal into an electrical level signal, and the second transmission unit is configured to transmit the electrical level signal to the driver circuit board;

wherein the convertor circuit board further comprises a voltage process unit; the voltage process unit is configured to receive a direct current voltage outputted by a power module, and to convert the direct current voltage into direct current voltages of different values for supplying the liquid crystal display backlight module;

wherein each of the second process unit, the second transmission unit, and the voltage process unit is in form of hardware, software, or a combination of hardware and software.

10. The liquid crystal display backlight module controlling device as claimed in claim 9, wherein the programmable logic gate array board comprises an extraction unit, a mapping unit, a first process unit, and a first transmission unit each of which is in form of hardware, software, or a combination of hardware and software; the extraction unit is configured to extract grayscale information from the image signal, the mapping unit is configured to map out the backlight information according to the grayscale information, the first process unit is configured to convert the backlight information into a low voltage differential signal, the first transmission unit is configured to transmit the low voltage differential signal to the convertor circuit board.

11. The liquid crystal display backlight module controlling device as claimed in claim 10, wherein the programmable logic gate array board further comprises a second extraction unit in form of hardware, software, or a combination of hardware and software; the second extraction unit is configured to extract clock information from the image signal, wherein the clock information is a timing signal for controlling display of a liquid crystal display panel.

12. The liquid crystal display backlight module controlling device as claimed in claim 9, wherein the voltage process unit comprises a boost unit, the boost unit is configured to increase a value of the direct current voltage for supply the liquid crystal display backlight module.

13. The liquid crystal display backlight module controlling device as claimed in claim 9, wherein the voltage process unit comprises a buck unit, the buck unit is configured to decrease a value of the direct current voltage for supplying the liquid crystal display backlight module.

14. The liquid crystal display backlight module controlling device as claimed in claim 9, wherein a number of the convertor circuit board is two.

15. The liquid crystal display backlight module controlling device as claimed in claim 9, wherein the driver circuit board comprises a third process unit, a third transmission unit and a lighting-up unit each of which is in form of hardware, software, or a combination of hardware and software; wherein the third process unit is configured to convert the electrical level signal into a row signal and a column signal, the transmission unit is configured to sequentially transmit the row signal and the column signal to the backlight light board, the row signal controls each row of the light emitting diodes of the backlight light board, the column signal controls each column of the light emitting diodes of the backlight light board, the lighting-up unit is configured to switch on corresponding ones of the light emitting diodes when both the row signal and the column signal are in a predetermined status with an identification value of switching on.

16. The liquid crystal display backlight module controlling device as claimed in claim 9, wherein the liquid crystal display backlight module further comprises a logic control board, the logic control board is configured to receive the clock information and processes the clock information to obtain a point-to-point signal and transmit the point-to-point signal to the liquid crystal display panel, and is configured to drive the liquid crystal display panel to display screen images.

17. The liquid crystal display backlight module controlling device as claimed in claim 16, wherein the logic control board comprises a fourth process unit and a fourth output unit each of which is in form of hardware, software, or a combination of hardware and software; wherein the fourth process unit is configured to process the clock information to obtain the point-to-point signal, the fourth output unit is configured to transmit the point-to-point signal to the liquid crystal display panel, and is configured to drive the liquid crystal display panel to display screen images.

* * * * *